US008035579B2

(12) United States Patent
Kim et al.

(10) Patent No.: US 8,035,579 B2
(45) Date of Patent: Oct. 11, 2011

(54) PLASMA DISPLAY PANEL DRIVING METHOD, PLASMA DISPLAY PANEL GRAY DISPLAYING METHOD, AND PLASMA DISPLAY DEVICE

(75) Inventors: Jin-Sung Kim, Suwon-si (KR); Woo-Joon Chung, Suwon-si (KR); Seung-Hun Chae, Suwon-si (KR); Jin-Boo Son, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 834 days.

(21) Appl. No.: 12/100,673

(22) Filed: Apr. 10, 2008

(65) Prior Publication Data

US 2008/0191972 A1 Aug. 14, 2008

Related U.S. Application Data

(63) Continuation of application No. 10/952,742, filed on Sep. 30, 2004, now Pat. No. 7,372,433.

(30) Foreign Application Priority Data

Oct. 1, 2003 (KR) ..... 10-2003-0068393
Oct. 24, 2003 (KR) ..... 10-2003-0074646

(51) Int. Cl.
*G09G 3/28* (2006.01)

(52) U.S. Cl. ..... 345/63; 315/169.1

(58) Field of Classification Search ..... 345/60, 345/63, 67; 315/169.1–169.4
See application file for complete search history.

(56) References Cited

U.S. PATENT DOCUMENTS

| | | | | |
|---|---|---|---|---|
| 6,628,087 | B2 * | 9/2003 | Roh et al. | 315/169.3 |
| 2002/0054001 | A1 * | 5/2002 | Awamoto | 345/60 |
| 2002/0186184 | A1 | 12/2002 | Lim | |
| 2003/0030598 | A1 | 2/2003 | Kanazawa | |
| 2003/0174102 | A1 * | 9/2003 | Jeong | 345/60 |
| 2003/0234753 | A1 * | 12/2003 | Tanaka | 345/67 |
| 2004/0125051 | A1 | 7/2004 | Hirakawa et al. | |
| 2004/0145542 | A1 | 7/2004 | Kim | |
| 2004/0233134 | A1 | 11/2004 | Shindo et al. | |
| 2005/0057451 | A1 | 3/2005 | Lim | |

FOREIGN PATENT DOCUMENTS

| | | |
|---|---|---|
| CN | 1271155 | 10/2000 |
| CN | 1438619 | 8/2003 |
| EP | 0961258 | 12/1999 |
| JP | 11065517 | 3/1999 |
| JP | 2001228821 | 8/2001 |
| JP | 2001318649 | 11/2001 |
| JP | 2002014652 | 1/2002 |
| JP | 2002298742 | 10/2002 |
| JP | 2002304153 | 10/2002 |

(Continued)

*Primary Examiner* — Quan-Zhen Wang
*Assistant Examiner* — Yuk Chow
(74) *Attorney, Agent, or Firm* — H.C. Park & Associates, PLC

(57) ABSTRACT

A plasma display panel (PDP) driving method and a PDP gray-representing method for improving representation performance of low gray scales is disclosed. A voltage rising from a low level voltage to a reset voltage of a reset period of a subsequent subfield is applied to a scan electrode, without having a sustain period, after performing an address operation of the subfield with the minimum weight. The discharge cell selected in the address period of the minimum weight is discharged in an initial part of the gradually rising voltage.

20 Claims, 5 Drawing Sheets

FOREIGN PATENT DOCUMENTS

| | | |
|---|---|---|
| JP | 2002366084 | 12/2002 |
| JP | 2003015602 | 1/2003 |
| JP | 2003066897 | 3/2003 |
| JP | 2003157047 | 5/2003 |
| KR | 1020040000327 | 1/2004 |

* cited by examiner

PLASMA DISPLAY PANEL DRIVING METHOD, PLASMA DISPLAY PANEL GRAY DISPLAYING METHOD, AND PLASMA DISPLAY DEVICE

CROSS REFERENCE TO RELATED APPLICATIONS

This application is a continuation of prior application Ser. No. 10/952,742, filed Sep. 30, 2004, which claims priority to and the benefit of Korea Patent Application No. 10-2003-0068393, filed on Oct. 1, 2003, and Korean Patent Application No. 10-2003-0074646, filed on Oct. 24, 2003, which are all hereby incorporated by reference for all purposes as if fully set forth herein.

BACKGROUND OF THE INVENTION

1. Field of the Invention

The present invention relates to a driving method for a plasma display panel (PDP). More specifically, the present invention relates to a PDP driving method for improving the ability to represent low gray scales.

2. Discussion of the Related Art

A PDP is a flat display panel that shows characters or images using plasma generated by gas discharge. PDPs may include millions of pixels in a matrix format, where the PDP's size determines the number of pixels. Referring to FIG. 1 and FIG. 2, a typical PDP structure will now be described.

FIG. 1 shows a partial perspective view of a PDP, and FIG. 2 schematically shows a PDP electrode arrangement.

As shown in FIG. 1, the PDP includes glass substrates 1 and 6 sealed together with a predetermined gap therebetween. Scan electrodes 4 and sustain electrodes 5 are formed in parallel pairs on the glass substrate 1, and they are covered with a dielectric layer 2 and a protection film 3. A plurality of address electrodes 8 is formed on the glass substrate 6, and they are covered with an insulating layer 7. Barrier ribs 9 are formed on the insulating layer 7 between the address electrodes 8, and phosphors 10 are formed on the surface of the insulating layer 7 and between the barrier ribs 9. The glass substrates 1 and 6 are provided facing each other with discharge spaces 11 formed between them. A portion of the discharge space 11 between an address electrode 8 and a crossing part of a pair of a scan electrode 4 and a sustain electrode 5 forms a discharge cell 12.

As shown in FIG. 2, the PDP electrodes have an n×m matrix format. The address electrodes $A_1$ to $A_m$ are arranged in the column direction, and n scan electrodes $Y_1$ to $Y_n$ and n sustain electrodes $X_1$ to $X_n$ are arranged in pairs in the row direction.

A subfield in the typical PDP driving method includes a reset period, an address period, a sustain period, and an erase period (waveforms within a subfield will be described for ease of description.)

In the reset period, charge states of the display cells are reset so that address operations may be effectively performed. In the address period (also known as a scan period or a write period), cells which are to be turned on are selected, and wall charges are accumulated in the selected cells (addressed cells). In the sustain period, a discharge for displaying actual images is performed. In the erase period, the wall charges on the cells are reduced, and the sustain discharge is terminated.

FIG. 3 shows a conventional PDP driving waveform and a quantity of light emitted by a subfield.

As shown in the conventional PDP driving method, a minimum unit of light, is a light of the subfield with a weight of 1.

It is represented as the sum of the light generated during the address period, the sustain period, and the reset period of the second subfield, which is immaterial. In other words, in the period of the first subfield, an address discharge (address light) forms positive wall charges at the scan electrode in the address period. The voltage at the scan electrode Y is set higher than the voltage at the sustain electrode X, to apply a sustain discharge voltage of Vs between them, thereby performing a sustain discharge (sustain light) in the sustain period. Next, the minimum unit of light is represented through a reset operation of the reset period of the second subfield. In this instance, the light emitted in the reset period is a bit less, so it is immaterial. The light for representing the second subfield (the weight of 2) is represented through the address discharge (address light) and the three sustain discharges (the sustain discharge voltage of Vs alternately applied to the scan electrode Y and the sustain electrode X) in the sustain period.

Therefore, since the minimum unit of light in the conventional PDP driving method includes light generated from an address discharge (address light) and a sustain discharge (sustain light), it is restricted in realizing the lower brightness. Further, since high Xe is currently used to increase emission efficiency, which increases the light generated by a single sustain discharge, a much lower minimum unit of light may be required to increase the representation performance of the low gray scales. Also, big differences of the representation performance of the low gray scales may be generated according to the brightness per sustain discharge pulse when representing low gray scales with few sustain discharge pulses.

SUMMARY OF THE INVENTION

The present invention provides a driving method for a PDP with an improved ability to represent low gray scales by reducing a minimum unit of light.

The present invention also provides a driving method for a PDP with reduced brightness between adjacent gray scales in the low gray scales.

Additional features of the invention will be set forth in the following description, and in part will be apparent from the description, or may be learned by practice of the invention.

The present invention discloses a method for driving a plasma display panel (PDP) having a first electrode, a second electrode, and a third electrode crossing the first electrode and the second electrode, wherein a discharge cell is formed by the first electrode, the second electrode, and the third electrode, and wherein a field is divided into a plurality of subfields. The method for driving at least one of the subfields comprises applying a first voltage and a second voltage to the first electrode and the third electrode, respectively, of a discharge cell to be selected to generate a first light. A voltage gradually rising from a third voltage to a fourth voltage is applied to the first electrode to generate a second light to the selected discharge cell.

The present invention also discloses a method for driving a plasma display panel (PDP) having a first electrode, a second electrode, and a third electrode crossing the first electrode and the second electrode, wherein a discharge cell is formed by the first electrode, the second electrode, and the third electrode, and wherein a field is divided into a plurality of subfields. The method for driving at least one of the subfields comprises applying a first voltage and a second voltage to the first electrode and the third electrode, respectively, of a discharge cell to be selected to generate a first light. A voltage gradually rising from a third voltage to a fourth voltage with a first slope is applied to the first electrode to generate a second light to the selected discharge cell. A voltage gradually rising from a fifth voltage with a second slope is applied to the first electrode to generate a third light to the selected discharge cell. The first slope is steeper than the second slope.

The present invention also discloses a method for representing gray scales on a plasma display panel (PDP) having a plurality of first and second electrodes, and a plurality of third electrodes crossing the first and second electrodes, wherein a field is divided into a plurality of subfields for realizing gray scales. The gray-representing method comprises representing a gray scale of a first subfield, showing a minimum weight from among the subfields, through an emitted light generated when a first voltage and a second voltage are respectively applied to the first electrode and the third electrode of a discharge cell to be selected during an address period of the first subfield.

The present invention also discloses a method for driving a plasma display panel (PDP) having a first electrode and second electrode formed in parallel on a first substrate, and a third electrode crossing the first electrode and the second electrode and being formed on a second substrate. A discharge cell is formed by the first electrode, the second electrode, and the third electrode. The driving method comprises applying a first voltage and a second voltage to the first electrode and the third electrode, respectively, of the discharge cell to be selected, and sustain-discharging the selected discharge cell. When sustain-discharging the selected discharge cell, a third voltage is applied to the first electrode and a fourth voltage is applied to the second electrode. A difference between the third voltage and the fourth voltage may gradually rise during a period for performing a sustain discharge.

The present invention also discloses a plasma display device where the driving circuit applies a first voltage and a second voltage to the first electrode and the third electrode, respectively, of a discharge cell to be selected in an address period. A subfield with a minimum weight is represented by using an emitted light generated by a difference between the first voltage and the second voltage It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

The following detailed description shows and describes exemplary embodiments of the invention simply to illustrate the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

A PDP driving method according to an exemplary embodiment of the present invention will now be described.

Figure 1:
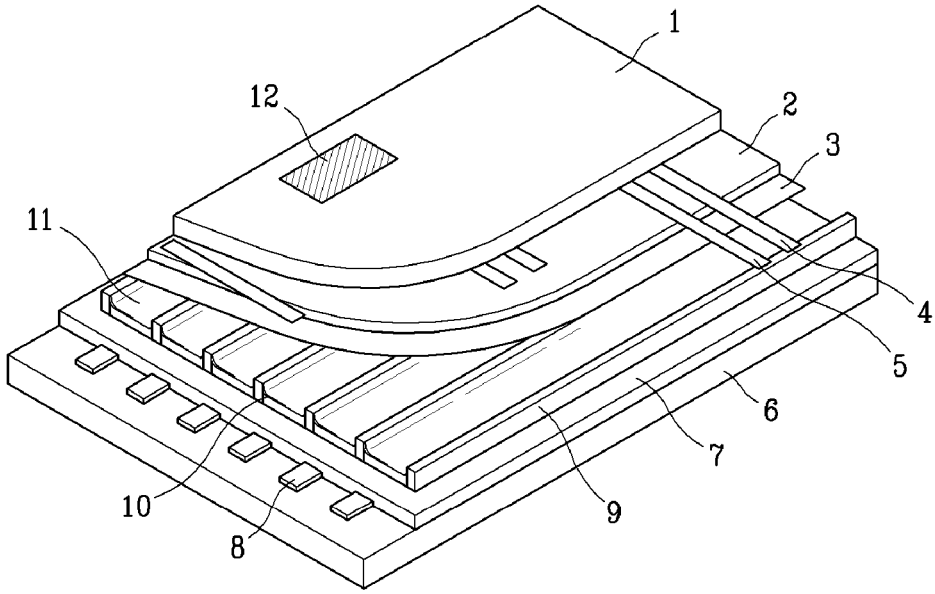
FIG. 1 (Prior Art)
FIG. 1 shows a partial perspective view of a typical PDP.
Figure 2:
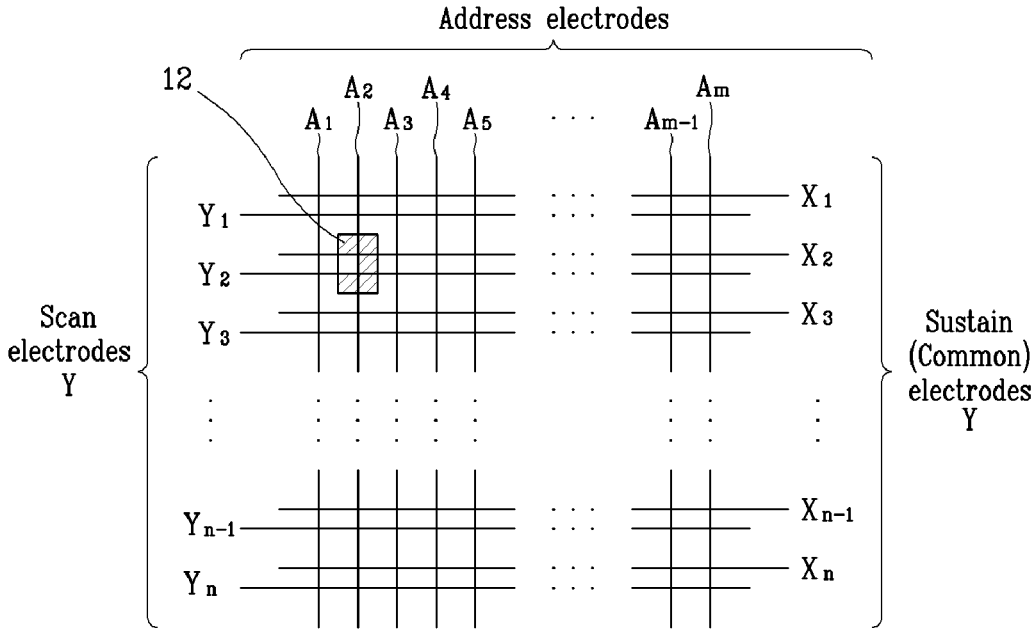
FIG. 2 (Prior Art)
FIG. 2 schematically shows a typical PDP electrode arrangement.
Figure 3:
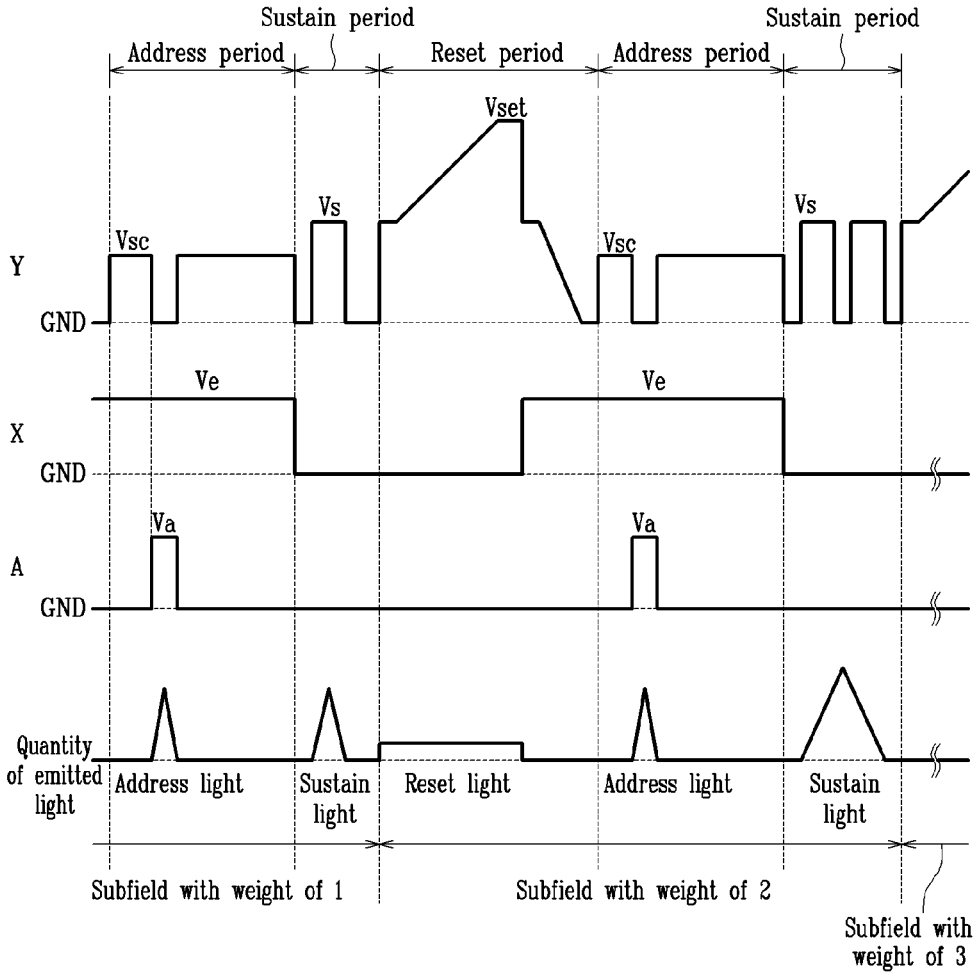
FIG.3(Prior Art)
FIG. 3 shows a conventional PDP driving waveform and a quantity of light emitted by a subfield.
Figure 4:
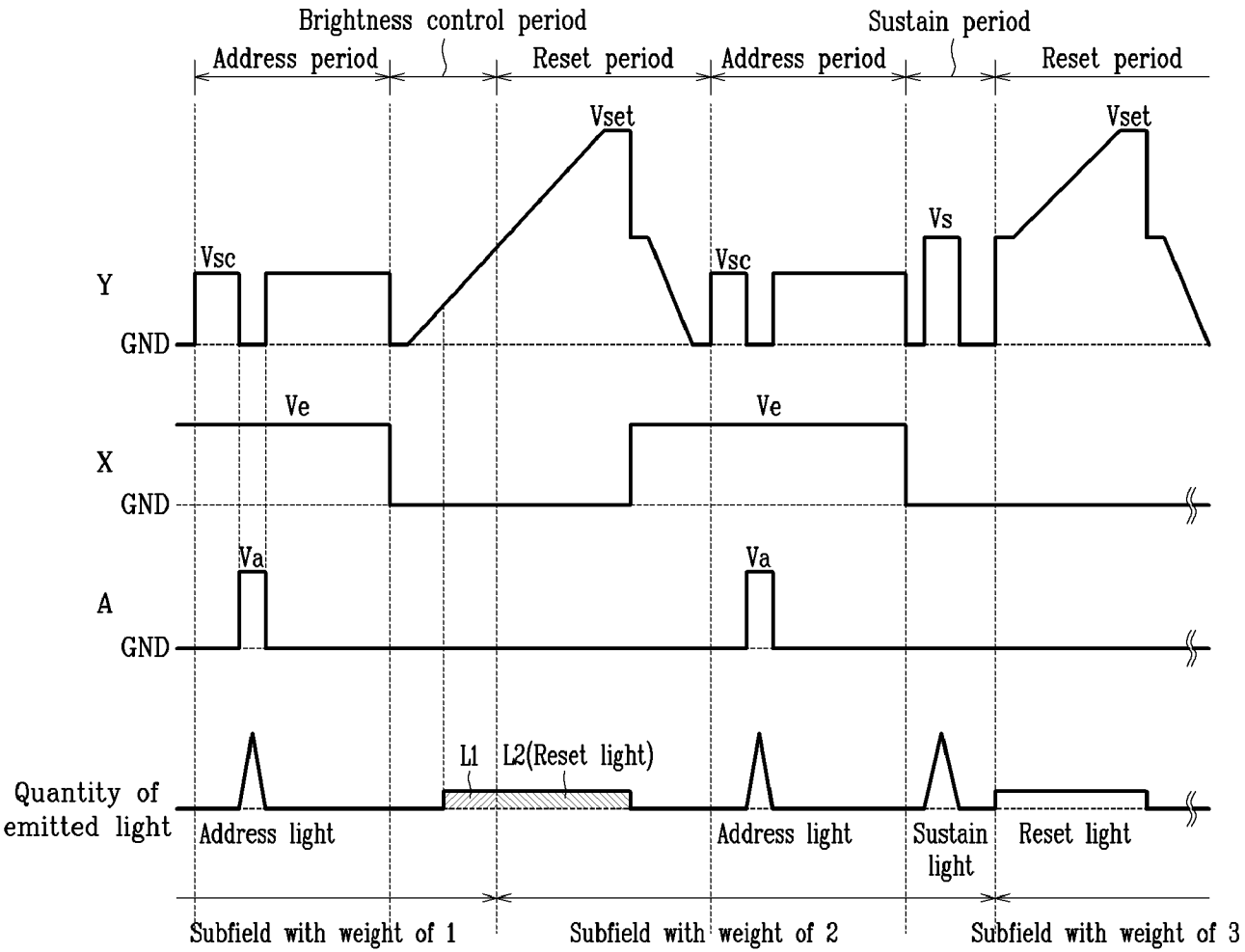
FIG. 4 shows a PDP driving waveform and amounts of light emitted in each subfield according to a first exemplary embodiment of the present invention.

FIG. 4 shows a PDP driving waveform and amounts of light emitted in each subfield according to a first exemplary embodiment of the present invention.

As shown, the driving waveform comprises a first subfield (a subfield with a weight of 1) having a reset period (not illustrated in FIG. 4), an address period, and a brightness control period, and a second subfield (a subfield with a weight of 2) having a reset period, an address period, and a sustain period. The PDP is coupled to a scan/sustain driving circuit (not illustrated) for applying driving voltages to the scan electrodes Y and the sustain electrodes X, and an address driving circuit (not illustrated) for applying a driving voltage to the address electrodes A. Those coupled driving circuits and the PDP configure a plasma display device.

During the address period, applying a positive voltage Va to the address electrode A and a low level ground voltage GND to the scan electrode Y performs an address discharge. The address discharge (address light) is generated between the address electrode A and the scan electrode Y, and positive wall charges are accumulated at the scan electrode Y. FIG. 4 shows a single address operation during the address period, and in the actual cases, the address voltage Va is applied to the address electrode A to be selected when all the scan electrodes Y are scanned to select a discharge cell.

The PDP driving method of the first exemplary embodiment of the present invention includes no sustain period after the address period of the first subfield (the subfield of a weight of 1). In other words, no sustain voltage is alternately applied to the scan electrode Y and the sustain electrode X to sustain discharge the selected cells. Rather, as shown in FIG. 4, a ramp waveform that gradually rises to a final reset voltage Vset of the second subfield (the subfield with a weight of 2) from the low level voltage GND of the first subfield is applied to the scan electrode Y after the address period. After a predetermined time, the ramp waveform generates a weak discharge (L1+L2 (reset light)) between the scan electrode Y and the sustain electrode X. The light L1 generated at an initial part of the weak discharge (L1+L2) is discharged at the selected cell during the brightness control period. Accordingly, the light L1 may represent the first subfield (the subfield of a weight of 1). In FIG. 4, the brightness control period starts after the address period of the first subfield and ends at the start of the reset period of the second subfield.

A weak discharge L2, which is a later part of the weak discharge (L1+L2), is generated at all of the display cells after a predetermined voltage, thereby starting the second subfield (a subfield with a weight of 2). The second subfield and subsequent subfields may correspond to the conventional waveforms, and a single sustain pulse Vs may be applied to the scan electrode Y in the sustain period in order to represent the weight of 2. Therefore, the light of the second subfield may be represented by the address light, the sustain light, and the latter part of the light in the reset period (which is in a reset period of the second subfield). Also, it is desirable to establish the light of the second subfield to be twice the light of the first subfield. In this instance, the light of the latter part of the reset period (which represents a reset period of the second subfield) represents the light emitted at all cells in the reset period, and it is immaterial since it is much smaller than the address light and the sustain light.

The sustain discharge pulses are applied during the sustain period so that the light of third subfield (a subfield with a weight of 4), the fourth subfield, and the fifth subfield may be four times, eight times, and sixteen times the light of the first subfield, respectively.

Accordingly, the light (i.e., the minimum unit of light) of the first subfield (the subfield with the weight of 1) may be represented by the total of the address light and the light (L1) generated at an initial part of the gradually rising waveform. Since the light L1 is immaterial because it is less than the address light, the address light may be used as the minimum unit of light (i.e., the light for representing the minimum weight). Therefore, the representation performance of low gray scales may be improved by reducing the brightness level of the minimum unit of light.

Figure 5:
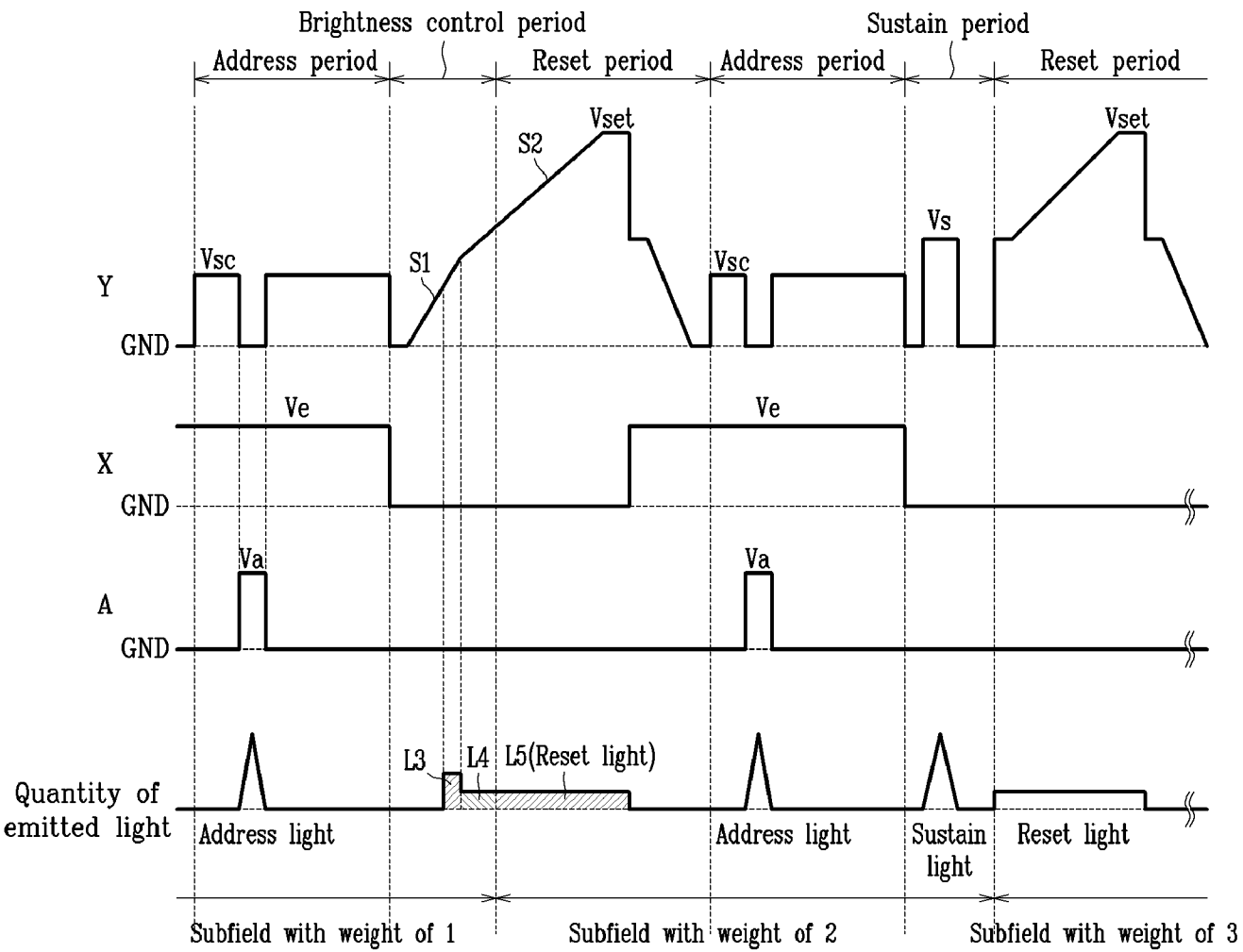
FIG. 5 shows a PDP driving waveform and amounts of light emitted in each subfield according to a second exemplary embodiment of the present invention.

FIG. 5 shows a PDP driving waveform and amounts of light emitted in each subfield according to a second exemplary embodiment of the present invention.

As shown, the PDP driving waveform according to the second exemplary embodiment differs from the waveform of FIG. 4 in that the waveform has two slopes S1 and S2. Setting the slope S1 steeper than the slope S2 generates a greater amount of light (L3>L4) to minutely control the minimum unit of light (i.e., the light of the first subfield). Brighter light may be generated to compare the light generated in the first and second subfields and to control a difference in amounts of light. The slope S1 may be steeper than the slope S2 so that the waveform may gradually rise to perform the reset operation of the second subfield. Therefore, the minimum unit of light according to the second exemplary embodiment may be given as the total of the address light, the light L3 caused by the waveform having the slope S1, and the light L4 caused by part of the waveform having the slope S2.

Similar to the first exemplary embodiment, a boundary point of the first and second subfields includes the point at which all panel cells are discharged by the rising curve. FIG. 5 shows that all panel cells are discharged at a predetermined point after the waveform with the slope S2 is applied. FIG. 5 is exemplary only, and the reset period of the second subfield may start at other points along the waveform having the slope S2.

The gradually rising waveform after the address period of the first subfield is shown as a ramp waveform in FIG. 4 and FIG. 5. It may include an RC waveform, a step waveform, which varies a predetermined voltage and maintains the voltage for a predetermined time, and a floating waveform, which repeatedly varies a predetermined voltage and floats the scan electrode Y at least once. Varying the slope as shown in FIG. 5 may control the intensity of the minimum unit of light by increasing or decreasing the voltage variation when applying the step waveform or the floating waveform.

Also, the diagrams of the quantity of the emitted light are illustrated with a straight line in FIG. 4 and FIG. 5, yet, the quantity of the emitted light may have other formats. Additionally, the weight of the first subfield is given as 1 for ease of description, but it may be other minimum weights such as 0.5 or 0.25.

The subfield having the minimum weight in the first and second exemplary embodiments may correspond to the subfield having the minimum weight applied when the automatic power control (APC) level is high since the image load ratio is high.

As discussed above, the quantity of light (i.e. brightness) between the gray scales may be controlled by applying a gradually rising waveform in the brightness control period. Alternatively, as described below, a gradually rising or falling ramp waveform may be applied instead of at least one sustain discharge pulse during the sustain period of the subfield with the minimum weight.

Figure 6:
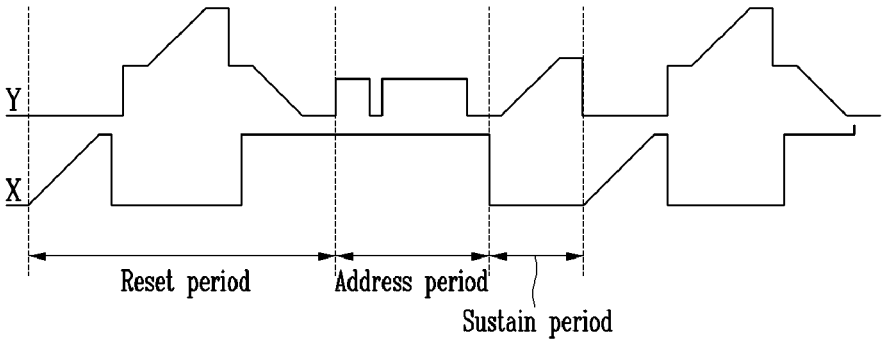
FIG. 6 and FIG. 7 show PDP driving waveforms according to a third exemplary embodiment of the present invention.
Figure 7:
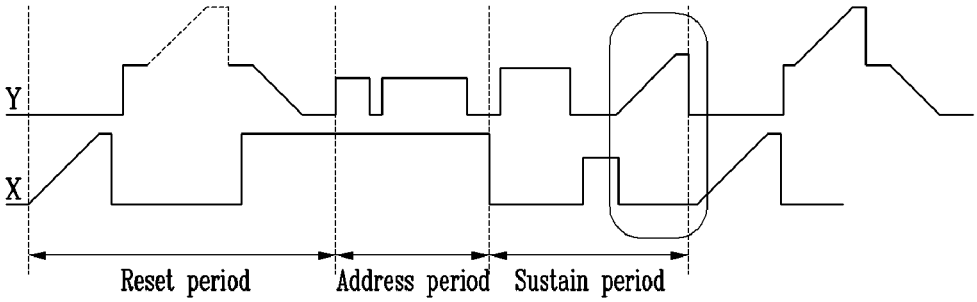

FIG. 6 and FIG. 7 show PDP driving waveforms according to a third exemplary embodiment of the present invention.

As shown in FIG. 6, a gradually rising voltage may be applied to the scan electrode Y and a ground voltage of 0V may be applied to the sustain electrode X in order to reduce the brightness of the sustain discharge pulse in the gray scales represented by a single pulse. Applying the gradually rising voltage to the scan electrode Y may generate a weak discharge to the sustain electrode X from the scan electrode Y, thereby reducing the quantity of light (i.e., the brightness), and levels of brightness between brightness levels resulting from 0 and 1 sustain discharge pulses may be represented.

Also, with three sustain discharge pulses as shown in FIG. 7, a gradually rising voltage may be applied to the scan electrode Y instead of applying the last sustain discharge pulse. The applied order of the sustain discharge pulse includes the last and other orders. Consequently, the difference of the quantities of light (i.e., the brightness) between the first gray represented by the subfield of FIG. 7 and the second gray, which is higher than the first gray by a level, may be reduced. The brightness level may be controlled by applying a gradually rising waveform, instead of a sustain discharge pulse, to the scan electrode Y and to the sustain electrode X.

In other words, the gray representation may be improved by applying one of the sustain discharge pulses as a gradually rising waveform as shown in FIG. 6 and FIG. 7, thus reducing the brightness difference between adjacent gray scales. It is desirable to apply the rising waveforms shown in FIG. 6 and FIG. 7 to the subfield representing low gray scales since problems may be generated due to differing quantities of light between the gray scales in the low gray scales.

The above-described gray corrected sustain discharge waveforms may produce light that is lower than the minimum unit of light of the conventional sustain discharge waveform, yet the waveforms of the driving signals may vary. In other words, any waveform that produces light lower than the minimum unit of light of the conventional sustain discharge waveform is acceptable.

Figure 8:
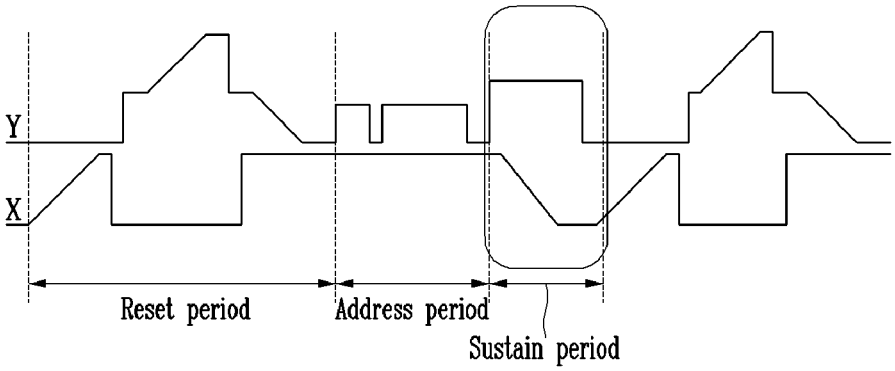
FIG. 8 shows a PDP driving waveform according to a fourth exemplary embodiment of the present invention.

FIG. 8 shows a PDP driving waveform according to a fourth exemplary embodiment of the present invention.

As shown, during the sustain period, unlike the third exemplary embodiment, the scan electrode Y may be biased with a constant voltage and a gradually falling voltage may be applied to the sustain electrode X. In this case, a weak discharge may be generated from the scan electrode Y to the sustain electrode X to reduce the quantity of light in the same manner of the third exemplary embodiment. The voltage recognized by the plasma within the discharge cell according to the fourth exemplary embodiment corresponds to that of the third exemplary embodiment, yet the voltages applied to the scan electrode Y and the sustain electrode X are different.

As described above, the minimum unit of light may be reduced by applying a waveform that gradually rises to the reset voltage of the reset period of the next subfield after the address period of the subfield with the minimum weight.

Representing the minimum unit of light with the address light and the initial part of the light of the gradually rising waveform may improve the representation performance of low gray scales.

Also, the quantities of light between adjacent gray scales in the low gray scales may be reduced by applying a gradually rising waveform or a gradually falling waveform instead of at least one sustain discharge pulse in the sustain period. This may reduce the quantity of light, thereby improving the representation performance of low gray scales.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of driving a plasma display panel comprising a first electrode, a second electrode, and discharge cells defined by the first electrode and the second electrode, the method comprising:

gradually increasing a voltage of the first electrode from a first voltage to a second voltage in a reset period of a first subfield;

gradually decreasing the voltage of the first electrode from a third voltage to a fourth voltage in the reset period of the first subfield;

selecting a first turn-on cell among the discharge cells in an address period of the first subfield;

gradually increasing the voltage of the first electrode from a fifth voltage to a sixth voltage at a first slope to discharge the first turn-on cell in a sustain period of the first subfield, a magnitude of the sixth voltage being less than a magnitude of the second voltage; and decreasing the voltage of the first electrode from the sixth voltage to the fifth voltage at a second slope after increasing the voltage of the first electrode from the fifth voltage to the sixth voltage, an absolute value of the second slope being greater than that of the first slope.

2. The method of claim 1, further comprising:

selecting a second turn-on cell among the discharge cells in an address period of a second subfield; and applying a seventh voltage higher than a ground voltage to the first electrode to discharge the second turn-on cell in a sustain period of the second subfield, a magnitude of the seventh voltage being less than the magnitude of the sixth voltage.

3. The method of claim 2, further comprising:

applying the ground voltage to the second electrode while gradually increasing the voltage of the first electrode from the fifth voltage to the sixth voltage; and applying the ground voltage to the second electrode while applying the seventh voltage to the first electrode.

4. The method of claim 2, further comprising applying the seventh voltage to the first electrode to discharge the first turn-on cell in the sustain period of the first subfield.

5. The method of claim 1, further comprising gradually increasing a voltage of the second electrode from the fifth voltage to the sixth voltage to discharge the first turn-on cell in the sustain period of the first subfield.

6. The method of claim 5, further comprising applying the ground voltage to the first electrode while gradually increasing the voltage of the second electrode from the fifth voltage to the sixth voltage.

7. The method of claim 1, wherein the fifth voltage is the ground voltage.

8. The method of claim 1, wherein the first subfield has a minimum weight.

9. A plasma display device, comprising:

a first electrode;

a second electrode;

discharge cells defined by the first electrode and the second electrode; and a driving circuit to gradually decrease the voltage of the first electrode from a first voltage to a second voltage after gradually increasing a voltage of the first electrode from a third voltage to a fourth voltage in a reset period of a first subfield, select a first turn-on cell among the discharge cells in an address period of the first subfield, gradually increase the voltage of the first electrode from a fifth voltage to a sixth voltage at a first slope to discharge the first turn-on cell during a first period of a sustain period of the first subfield, a magnitude of the sixth voltage being less than a magnitude of the fourth voltage, and decrease the voltage of the first electrode from the sixth voltage to the fifth voltage at a second slope after increasing the voltage of the first electrode from the fifth voltage to the sixth voltage, an absolute value of the second slope being greater than that of the first slope.

10. The plasma display device of claim 9, wherein the driving circuit is configured to select a second turn-on cell among the discharge cells in an address period of a second subfield, and to apply a seventh voltage higher than a ground voltage to the first electrode to discharge the second turn-on cell during a second period of a sustain period of the second subfield, and wherein a magnitude of the seventh voltage is less than the magnitude of the sixth voltage.

11. The plasma display device of claim 10, wherein the driving circuit is configured to apply the ground voltage to the second electrode during the first period, and to apply the ground voltage to the second electrode during the second period.

12. The plasma display device of claim 10, wherein the driving circuit is configured to apply the seventh voltage to the first electrode to discharge the first turn-on cell during a third period of the sustain period of the first subfield.

13. The plasma display device of claim 9, wherein the driving circuit is configured to gradually increase a voltage of the second electrode from the fifth voltage to the sixth voltage to discharge the first turn-on cell during a second period of the sustain period of the first subfield.

14. The plasma display device of claim 13, wherein the driving circuit is configured to apply the ground voltage to the first electrode during the second period.

15. The plasma display device of claim 9, wherein the first subfield has a minimum weight.

16. A plasma display device, comprising:

a first electrode;

a second electrode;

discharge cells defined by the first electrode and the second electrode; and a driving circuit to gradually decrease the voltage of the first electrode from a first voltage to a second voltage after gradually increasing a voltage of the first electrode from a third voltage to a fourth voltage to reset the discharge cells in a reset period of a first subfield, select a first turn-on cell among the discharge cells in an address period of a second subfield, gradually increase the voltage of the first electrode from a fifth voltage to a sixth voltage at a first slope to discharge the first turn-on cell in a sustain period of the second subfield, a magnitude of the sixth voltage being less than a magnitude of the fourth voltage, decrease the voltage of the first electrode from the sixth voltage to the fifth voltage at a second slope after increasing the voltage of the first electrode from the fifth voltage to the sixth voltage, an absolute value of the second slope being greater than that of the first slope, select a second turn-on cell among the discharge cells in an address period of a third subfield, and apply a seventh voltage higher than a ground voltage to the first electrode to discharge the second turn-on cell in a sustain period of the third subfield, a magnitude of the seventh voltage being less than the magnitude of the sixth voltage.

17. The plasma display device of claim 16, wherein the driving circuit is configured to apply the ground voltage to the second electrode while gradually increasing the voltage of the first electrode from the fifth voltage to the sixth voltage.

18. The plasma display device of claim 16, wherein the driving circuit is configured to apply the ground voltage to the second electrode while applying the seventh voltage to the first electrode.

19. The plasma display device of claim 16, wherein the driving circuit is configured to gradually increase a voltage of the second electrode from the fifth voltage to the sixth voltage to discharge the first turn-on cell while applying a ground voltage to the first electrode, in a sustain period of the second subfield.

20. The plasma display device of claim 16, wherein the second subfield has a minimum weight.

* * * * *